US007424892B2

(12) United States Patent
Lanoie et al.

(10) Patent No.: US 7,424,892 B2
(45) Date of Patent: Sep. 16, 2008

(54) METHOD AND APPARATUS FOR SAFELY CLEANING A LIVE EQUIPMENT

(75) Inventors: Robert Lanoie, St-Hubert (CA); Dave Bouchard, Ste-Julie (CA); Yvon Turcotte, Anjou (CA)

(73) Assignee: Hydro-Québec, Monteal, Québec (CA)

( * ) Notice: Subject to any disclaimer, the term of this patent is extended or adjusted under 35 U.S.C. 154(b) by 66 days.

(21) Appl. No.: 10/462,817

(22) Filed: Jun. 17, 2003

(65) Prior Publication Data

US 2004/0255986 A1 Dec. 23, 2004

(51) Int. Cl.
*B08B 3/10* (2006.01)

(52) U.S. Cl. ..... 134/105; 134/107; 134/198

(58) Field of Classification Search ..... None
See application file for complete search history.

(56) References Cited

U.S. PATENT DOCUMENTS 1,994,259 A * 3/1935 Thorne ..... 174/31 R
2,083,800 A * 6/1937 Woelflin ..... 204/569
2,357,354 A * 9/1944 Penney ..... 96/27
2,582,133 A * 1/1952 Karlsson ..... 96/40
2,949,168 A * 8/1960 Peterson ..... 96/27
3,074,649 A * 1/1963 Atkinson ..... 239/165
3,098,890 A * 7/1963 Peterson ..... 174/8
3,306,309 A * 2/1967 Pahl et al. ..... 134/80
3,331,163 A * 7/1967 Gregory ..... 451/99
3,331,192 A * 7/1967 Peterson ..... 96/27
3,606,172 A * 9/1971 Sato et al. ..... 239/587.5
3,913,836 A * 10/1975 Stevenson ..... 239/166
4,062,277 A 12/1977 Powers
4,388,487 A * 6/1983 Petrossian-Avakian .... 174/40 R
4,477,289 A * 10/1984 Kurtgis ..... 134/34
4,565,321 A 1/1986 Vestergaard
4,773,592 A * 9/1988 Oberdorfer ..... 239/126
4,821,958 A 4/1989 Shaffer
4,826,107 A 5/1989 Thornton-Trump
4,877,422 A * 10/1989 Walbridge et al. ..... 95/25
4,898,330 A 2/1990 Betchan
4,971,082 A * 11/1990 Kovaletz ..... 134/34

(Continued)

FOREIGN PATENT DOCUMENTS

DE 2 123 203 * 8/1972

(Continued)

OTHER PUBLICATIONS

Christopherson, Norm. "Superheat & Subcooling Sensible & Latent Heats Made Simple". <http://www.bacharach-training.com/norm/superheat.htm>.*

(Continued)

*Primary Examiner*—Frankie L Stinson
(74) *Attorney, Agent, or Firm*—Foley & Lardner LLP

(57) ABSTRACT

The method and apparatus are for safely cleaning live equipment. The method comprises the steps of heating a water-based solution by means of an apparatus to produce superheated steam; grounding this apparatus; conducting the superheated steam through an insulated conduit; and concentrating this superheated steam into a pressurized jet at an output of the insulated conduit. After the step of grounding the apparatus, the method further comprises the step of applying the pressurized jet through the insulated conduit output, onto the live equipment to be cleaned.

9 Claims, 2 Drawing Sheets

U.S. PATENT DOCUMENTS

| | | | | | |
|---|---|---|---|---|---|
| 5,028,017 | A | | 7/1991 | Simmons et al. | |
| 5,041,164 | A | * | 8/1991 | Hingorani | 134/22.12 |
| 5,106,427 | A | * | 4/1992 | Paris | 134/34 |
| 5,119,851 | A | * | 6/1992 | Paris | 134/172 |
| 5,120,370 | A | * | 6/1992 | Mori et al. | 134/22.15 |
| 5,122,192 | A | * | 6/1992 | Inukai et al. | 134/37 |
| 5,193,587 | A | | 3/1993 | Miller, Jr. | |
| 5,667,139 | A | * | 9/1997 | Dickie | 239/263.3 |
| 5,746,396 | A | | 5/1998 | Thorton-Trump | |
| RE35,879 | E | * | 8/1998 | Castelli et al. | 427/461 |
| 6,042,023 | A | | 3/2000 | Ask | |
| 6,049,658 | A | * | 4/2000 | Schave et al. | 392/472 |
| 6,061,866 | A | * | 5/2000 | Friedheim | 15/303 |
| 6,126,083 | A | | 10/2000 | Boschung et al. | |
| 6,148,732 | A | * | 11/2000 | Conway et al. | 104/279 |
| 6,237,861 | B1 | | 5/2001 | Northrop et al. | |
| 6,264,142 | B1 | | 7/2001 | Voss et al. | |
| 6,659,115 | B1 | * | 12/2003 | Wieczorek | 134/120 |

FOREIGN PATENT DOCUMENTS

| | | | | |
|---|---|---|---|---|
| DE | 33 10 764 | | * | 10/1984 |
| JP | 60-161229 | | * | 8/1985 |
| JP | 07057577 | A | * | 3/1995 |
| JP | 8-222059 | | * | 8/1996 |
| JP | 10255571 | A | * | 9/1998 |
| JP | 10-296195 | | * | 11/1998 |
| JP | 11-273479 | | * | 10/1999 |
| JP | 11319632 | A | * | 11/1999 |
| JP | 2002172365 | A | * | 6/2002 |
| SU | 1686496 | | * | 10/1991 |

OTHER PUBLICATIONS

"IEEE Guide for Cleaning Insulators", IEEE Standards Board, IEEE Std 957-1995, Approved Mar. 16, 1995, pp. 1-55.

* cited by examiner

METHOD AND APPARATUS FOR SAFELY CLEANING A LIVE EQUIPMENT

TECHNICAL FIELD

The present invention relates to a method and apparatus for safely cleaning live equipment. More particularly, the present invention is for cleaning live disconnector switches.

BACKGROUND OF THE INVENTION

The field of live electrical equipment has been faced with a number of impediments hindering their proper function. More precisely, proper maintenance of such equipment is crucial.

One of the main problems related to substation electrical equipment maintenance is pollution. Indeed, pollution deposits on substation electrical equipment reduce their insulation and can produce flashovers. It is imperative to clean this pollution in order to increase power reliability. In the past, substations were easily turned off and cleaned with high pressure water or other techniques. Nowadays, substations cannot be turned off without affecting in some way the customer. There is a dire need for a way to safely clean live electrical equipment.

Furthermore, in multiple areas, atmospheric pollution or salty deposits from the ocean are affecting the characteristics of insulators by accumulating on the exposed side of such insulators and thus forming a conductive coating. A currently-used method for cleaning live equipment is to pump deionized water with a high flow rate. However, this method requires a big reservoir and an increased distance of operation with increased voltage level. This method is useless over a certain wind velocity and is not used for de-icing because it requires a large heating capacity and the splashing water produces an ice build-up on adjacent equipment.

Moreover, during the last severe ice storm in North America, it was recognized that substation live equipment covered with a few inches of ice was difficult to operate. This applies mainly to disconnector switches. This situation is understandably unacceptable for substation operation.

Removal of pollution accumulation on live substation equipment can be accomplished by high pressure water spray and fixed water spray systems as presented in the IEEE Guide for cleaning Insulators (Institute of Electrical and Electronics Engineers Standard ("IEEE Std") 957-1995). A somewhat similar system is disclosed in U.S. Pat. No. 4,477,289 granted to KURTGIS. More precisely, this patent describes a system based on pressurized vaporisation for washing insulating components of high-voltage transmission lines. This system can be used for washing both energized and non-energized equipment. In such a system, a helicopter provides an airborne, mobile and ungrounded washing apparatus. As can be appreciated, both of the above-mentioned systems require a great amount of water, with low conductivity. Water splashing can also produce equipment flashover depending on the severity of pollution accumulation on the equipment. The wind can considerably reduce the cleaning efficiency because the water jets are strongly dispersed. Finally, the method disclosed by KURTGIS in particular, cannot be applied for substation equipment cleaning because it does not meet safety regulation requirements.

Also known in the art is U.S. Pat. No. 4,898,330 granted to BETCHAN in which is described a manually operated de-icer sprayer wherein a de-icing fluid is heated with an electrical heater means. As can be easily understood, such a manual system presents major hazards for the operator, especially during storms. Moreover, the operator, who has to remain outside under such intense weather, might not be able to stay long enough at the washing site until completion of the work.

Removal of ice accumulation on substation equipment may be accomplished by de-icing systems, such as illustrated in U.S. Pat. No. 4,565,321 granted to VESTERGAARD, U.S. Pat. No. 5,028,017 to SIMMONS et al. and U.S. Pat. No. 5,746,396 to THORNTON-TRUMP. One of the drawbacks of this technique is that the substation must be turned off before de-icing begins. This can be impossible or very difficult to achieve especially during winter and mainly in the midst of winter storms. Furthermore, in order to de-ice live substations, one should use heated demineralised spray water and respect a safe distance between the spray nozzle and the live equipment such as to prevent flashover in the water jet. Moreover, since the water jet is heated, it has a non-negligible conductivity and conducting current can thus be carried by the water. Finally, very strong winds blowing during ice storms can reduce the water jet efficiency to zero since the jet is strongly dispersed in such conditions. The use of water jets will also produce icing and wetting on nearby equipment not under de-icing and can make the situation even worse than before. Therefore, the use of heated demineralised spray water is not recommendable.

Also known by the Applicant are the following U.S. patent numbers which describe different washing (de-icer) systems: U.S. Pat. No. 4,062,277; U.S. Pat. No. 4,821,958; U.S. Pat. No. 5,193,587; U.S. Pat. No. 6,042,023; U.S. Pat. No. 6,126,083; U.S. Pat. No. 6,237,861; U.S. Pat. No. 6,264,142; U.S. Pat. No. 4,826,107.

A major drawback of the prior art is that it does not provide a method and an apparatus for safely and efficiently cleaning live electrical equipment.

SUMMARY OF THE INVENTION

An object of the present invention is to provide a method and apparatus for cleaning live equipment that are safe and more efficient than methods and apparatus of the prior art. In other words, such safe and efficient cleaning is achieved without exposing the personnel to flashover and ice falling down.

In accordance with the present invention, the above object is achieved by a method for safely cleaning live equipment, the method comprising the steps of:

a) heating a water-based solution by means of an apparatus to produce superheated steam;
b) grounding said apparatus;
c) conducting the superheated steam through an insulated conduit;
d) concentrating said superheated steam into a pressurized jet at an output of the insulated conduit; and
e) after step b), applying said pressurized jet through said output, onto the live equipment for cleaning said equipment.

Another object of the present invention is to provide an apparatus for safely cleaning live equipment, the apparatus comprising:

heating means for heating a water-based solution to produce superheated steam;
grounding element for grounding said apparatus;
an insulated conduit having an input connected to the output of the heating means, and an output; and
a nozzle connected to the output of the insulated conduit for concentrating said superheated steam into a pressurized jet usable for cleaning the live equipment.

The invention and its advantages will be better understood upon reading the following non-restrictive description of preferred embodiments thereof, made with reference to the accompanying drawings.

DETAILED DESCRIPTION OF THE INVENTION

Figure 1:
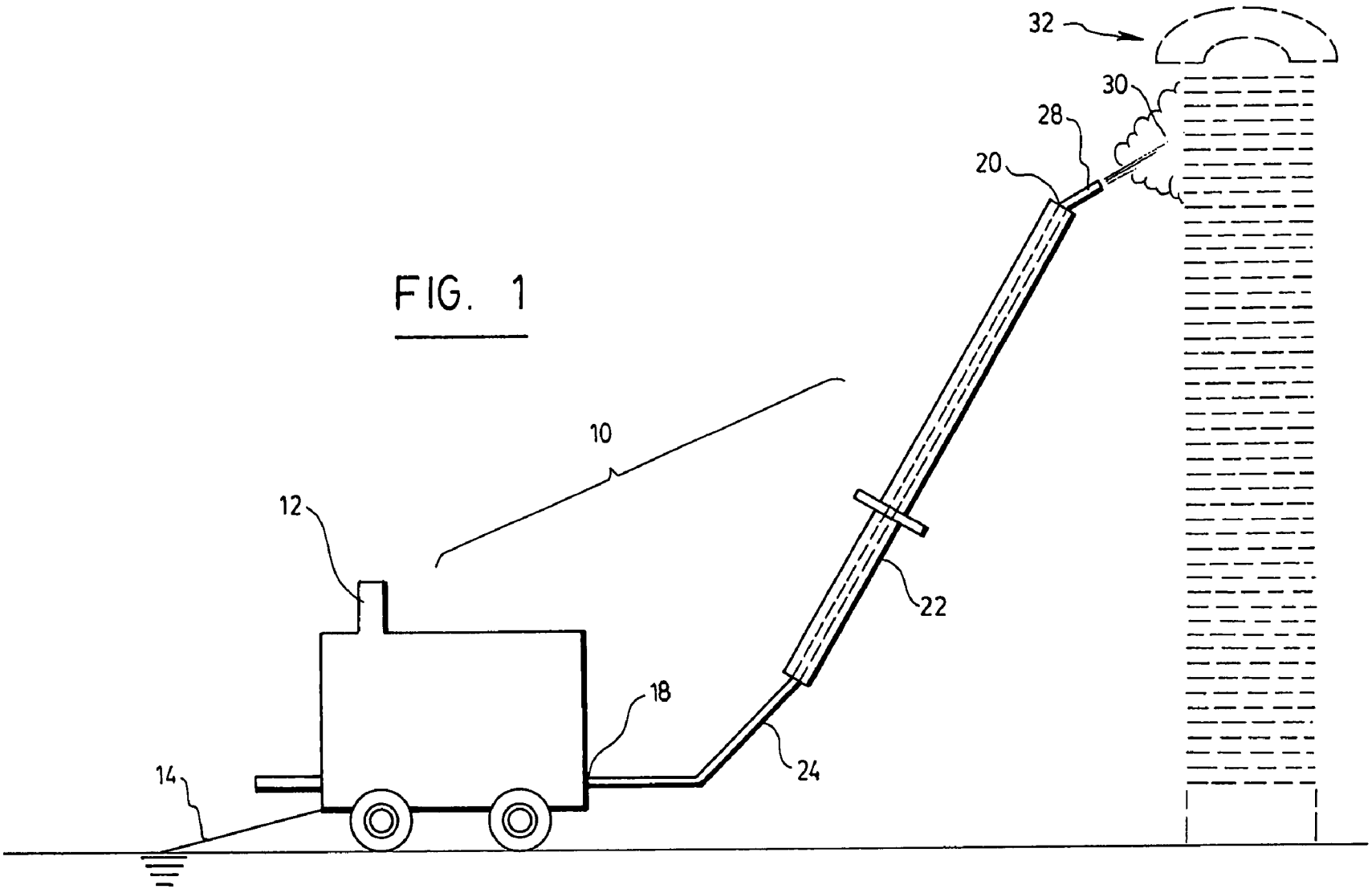
FIG. 1. Schematic view of a preferred embodiment of an apparatus according to the invention, in relation to a live equipment to be cleaned.

In the following description, similar features in the drawings have been given similar reference numerals and in order to lighten the figures, some elements are not referred to in some figures if they were already identified in a previous figure.

Referring now to FIG. 1, one can see a cross-sectional view of the apparatus 10 according to a preferred embodiment of the invention. The apparatus 10 is used for safely cleaning live equipment. This apparatus 10 comprises heating means, preferably a boiler 12 and more preferably a mobile boiler 12, for heating a water-based solution to produce superheated steam. A grounding element 14 is provided for grounding this apparatus 10. The apparatus 10 also comprises an insulated conduit having an input 18 connected to the output of the boiler 12. A nozzle 28 is connected to the output 20 of the insulated conduit for concentrating the superheated steam into a pressurized jet 30 usable for cleaning the live equipment 32.

Preferably, the boiler 12 has an operating pressure ranging from 70 to 125 pounds per square inch gauge ("psig"), and delivers a maximum flow of 150 pounds/hour ("lbs./hour") of superheated steam. Preferably also, the insulated conduit has rigid 22 and flexible 24 portions. The rigid portion 22 of the insulated conduit is at least 2 meters long. The rigid portion 22 of the insulated conduit can also withstand a maximum operating pressure of 150 psig. Preferably also, under dry conditions, this rigid portion 22 of the insulated conduit can withstand an alternating current ("AC") phase-to-neutral voltage of 140 kilovolts per meter ("kV/meter") of rigid portion, at a frequency of 60 Hertz ("Hz"). Still preferably, under dry conditions, the rigid portion 22 of the insulated conduit allows a maximum conducting current of 2 milliampere ("mA") when subjected to an AC phase-to-neutral voltage of 52 kV/meter of rigid portion.

Preferably, the flexible portion 24 has an internal diameter ranging from ⅜ to ½ inch, and can also withstand a maximum operating pressure of 300 psig.

Preferably also, when the insulated conduit consists only of a flexible portion 24, this flexible portion 24 withstands an AC phase-to-neutral voltage of 450 kV/2.7 meters of flexible portion, at a frequency of 60 Hz, under dry conditions. Under wet conditions, the flexible portion 24 can withstand an AC phase-to-neutral voltage of 240 kV/2.7 meters of flexible portion, at a frequency of 60 Hz. In another preferred embodiment under said wet conditions, the flexible portion 24 can withstand a switching voltage of 850 kV/2.7 meters of flexible portion. Furthermore, the flexible portion 24 can allow a maximum conducting current of 2 mA when subjected to an AC phase-to-neutral voltage of 240 kV/2.7 meters of flexible portion. As used herein, the expression "wet conditions" refers to conditions which are similar to rain having a conductivity of micro Siemens per centimeter ("μS/cm").

Figure 2:
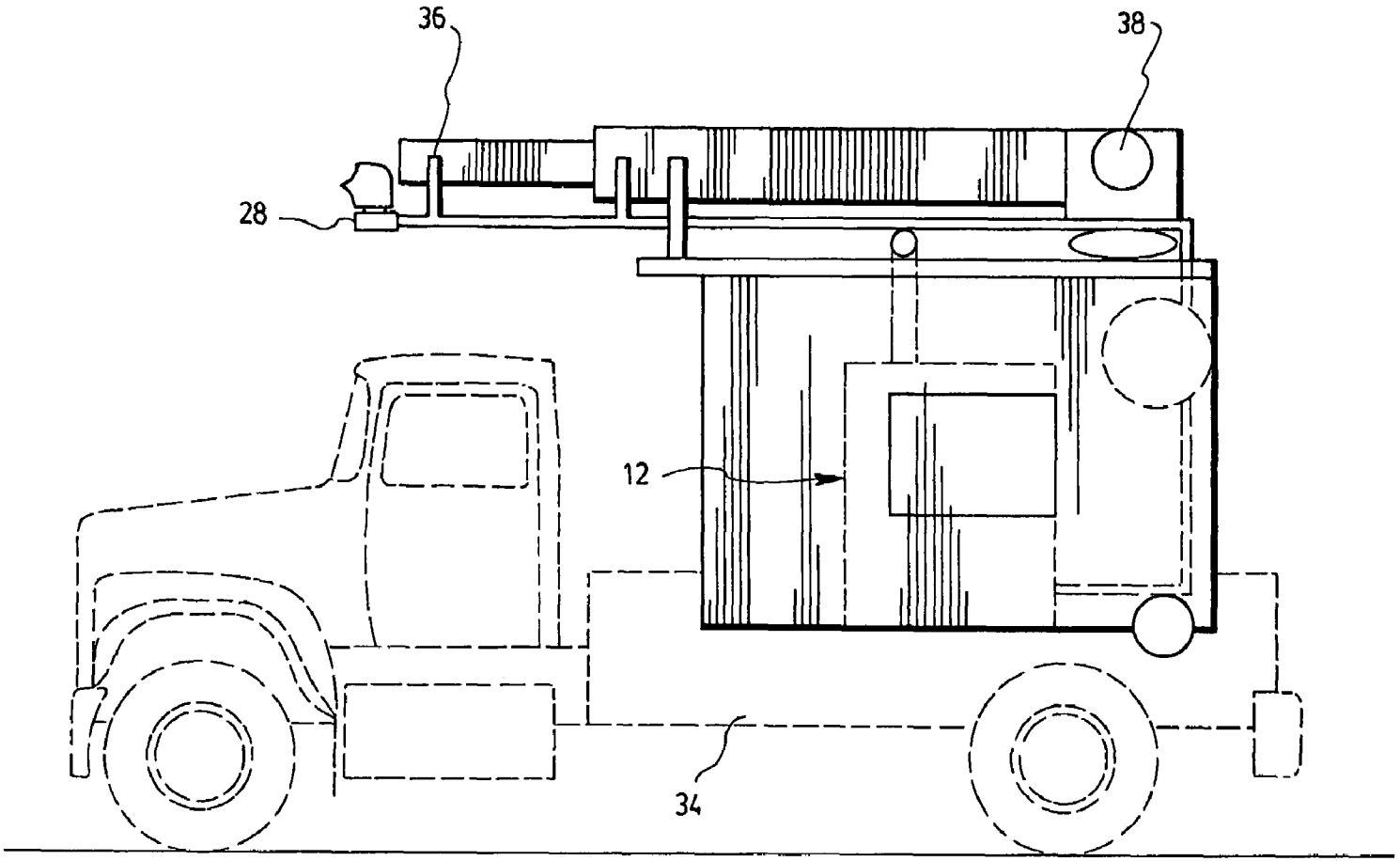
FIG. 2. Schematic view of another preferred embodiment of an apparatus according to the invention.

Referring now to FIG. 2, one can see a schematic view of the apparatus 10 according to yet another preferred embodiment of the invention. As can be depicted, the apparatus 10 according to the invention is placed on an undercarriage 34, and further comprises an insulated boom 36 supporting the insulated conduit and used for positioning the nozzle 28 near the live equipment 32 to be cleaned. This insulated boom 36 comprises one or more insulated sections. The total length of these insulated sections can range from 1 to 15 meters, depending on the distance separating the boiler 12 from the equipment 32 to be cleaned. Preferably also, the insulated boom 36 can be longer than 15 meters.

Preferably, under dry conditions, the insulated boom 36 withstands an AC phase-to-neutral voltage of 450 kV/2.7 meters of insulated boom, at a frequency of 60 Hz. Under the above-mentioned wet conditions, the insulated boom 36 preferably withstands an AC phase-to neutral voltage of 240 kV/2.7 meters of insulated boom, at a frequency of 60 Hz. The insulated boom 36 can also withstand a switching voltage of 850 kV/2.7 meters of insulated boom, under said wet conditions.

The present invention also relates to a method for safely cleaning live equipment 32. Referring to FIG. 1, this method comprises the steps of a) heating a water-based solution by means of an apparatus 10 to produce superheated steam; b) grounding this apparatus 10; c) conducting the superheated steam through an insulated conduit; d) concentrating said superheated steam into a pressurized jet 30 at an output 20 of the insulated conduit; and e) after step b), applying said pressurized jet 30 through the insulated conduit output 20, onto the live equipment to be cleaned.

Preferably, step a) of the method comprises steps of heating said water-based solution to produce steam, and heating said steam to produce superheated steam. This heating step can be accomplished by a boiler 12 which is used to heat the water-based solution until steam is produced. The steam thus produced is then heated, while still being confined within the boiler 12. As pressure builds up within the boiler 12, superheated steam is produced. According to the present invention, this superheated steam is produced under a pressure ranging from 75 to 115 psig.

Another advantage of the present invention is the availability of the initial product to be used in the present invention, namely a water-based solution of variable conductivity which, upon simple heating, is transformed into superheated steam characterized in that it presents a relatively low conductivity. Superheated steam of the present invention has thus been discovered to be a tool of choice for use on live equipment 32. Preferably, the superheated steam produced in step a) of the present invention has a maximum conductivity of 1.5 μS/cm, more preferably ranging from 0.05 to 1.5 μS/cm.

Preferably, in step e) of the method, the pressurized jet 30 is applied onto the live equipment 32 by positioning the insulated conduit output 20 at a maximum distance of six inches from the live equipment 32.

As best shown in FIG. 1, the superheated steam is conducted through an insulated conduit at the end of which an outlet nozzle 28 is attached. According to the method of the present invention, this outlet nozzle 28 is directed toward the live equipment 32 to be cleaned. The present apparatus 10 is an improvement over existing systems due to its increased efficiency, safety and cost effectiveness.

The method of the invention can be applied under extreme weather conditions such as strong winds or low outdoor temperatures (−25° C.), without producing splashing on nearby live equipment. Thanks to the high pressure built up from the boiler 12, the cleaning of live equipment can be achieved rapidly, often in only few minutes. The insulated conduit can be moved manually, as shown in FIG. 1, or be attached to an insulated boom 36, the boom being fixed to a lifting device 38 to provide greater manoeuvrability, as depicted in FIG. 2.

The apparatus 10 of the present invention can be used to clean live substation equipment over a wide voltage range, namely from 25 kV up to 315 kV actually and possibly up to 800 kV. With regard to the use of the present apparatus 10, two preferred embodiments can be cited, one for low structures corresponding to equipment under 75 kV and a second one for high structures corresponding usually to equipment up to 800 kV. Superheated steam, as described hereinabove, is used in both cases and is produced by a heating means, preferably mobile, which self-contains the initial water-based solution and its operating fuel.

On low structures and under 75 kV, as shown in FIG. 1, a hand manoeuvrable insulated conduit can be used from the ground. Alternatively, although not shown, a small lifting device attached to a basket for one or two men can be used to reach slightly higher structures.

According to the preferred embodiment depicted in FIG. 2, it is clearly shown that the apparatus 10 can be mounted on an undercarriage 34, such as a pickup truck or on a small trailer. This embodiment is particularly used for high rise structures. In this environment, an insulated boom 36, preferably a completely dielectric telescopic boom, is mounted on a pickup truck with the boiler 12 underneath. This boom 36 can reach up to 59 feet close to the truck, it is radio-controlled and can work under severe weather conditions such as rain, freezing rain, strong winds reaching up to 50 km/h in velocity, or under a wide range of temperatures ranging from +50° C. to −35° C.

Preferably, the apparatus 10 and method of the present invention teach the use of a relatively long boom 36, preferably retractable for storage purposes, transported on a small carrier 34 without the use of stabilisation jack arms on each side of the carrier. This particularly facilitates cleaning equipment or structures located in hard-to-reach places or sites located on unlevelled ground. In such complex settings, the telescopic boom 36 can be completely extended, even at a small angle of elevation almost horizontally and sideways, without excessive tilting of a light carrier. The present invention thus provides a small self-contained and cost-effective cleaning system for high-voltage energized equipment for transportation and distribution.

Due to the simplicity of operation and relatively low cost, the present apparatus 10 may be used for different purposes such as cleaning concrete and steel bridges, building facades, rapid removal of pollution on outside structures or rapid removal of graffiti, among others.

Preferably, the main factors involved in enabling the above-mentioned effects, as illustrated in FIGS. 1 and 2, are the following: the physical properties of the initial water-based solution and the final superheated steam; and the length and internal diameter of the insulated conduit.

As may now be appreciated, the apparatus 10 and method disclosed in the present invention are easily distinguishable from the prior art from which the following problems arise. First of all, great amounts of high-pressure fluid are needed for proper cleaning of live equipment. Furthermore, liquid splashing can produce equipment flashover. Moreover, high winds can reduce cleaning efficiency because of strong dispersion of fluid jets, thus weakening their strength. In certain situations, it was necessary to de-energise the equipment before cleaning it. Understandably, this was a difficult and often impossible task to perform during winter and particularly under stormy weather. Another disadvantage is the use of a heated water jet which means relatively high conductivity, a great hazard around live equipment. Finally, use of water jets can produce icing and wetting on nearby live equipment not under cleaning and can make the situation even worse than before.

In this connection, the safe, efficient and cost-effective apparatus 10 and method of the present invention provide a substantial improvement over the above-mentioned major drawbacks of the prior art.

Of course, numerous modifications could be brought to the above-described embodiments without departing from the scope of the invention as defined in the appended claims.

The invention claimed is:

1. An apparatus for safely cleaning live equipment, the apparatus comprising:

heating means for heating a water-based solution to produce steam and for heating said steam to produce superheated steam, comprising an output;

a grounding element for grounding said apparatus;

an electrically non-conducting conduit having an output and an input connected to the output of the heating means, the conduit having a flexible portion and wherein that said flexible portion:

withstands an AC phase-to-neutral voltage of 450 kV/2.7 meters of flexible portion, at a frequency of 60 Hz, under dry conditions;

withstands an AC phase-to-neutral voltage of 240 kV/2.7 meters of flexible portion, at a frequency of 60 Hz, under wet conditions similar to rain having a conductivity of 15 μS/cm;

withstands a switching voltage of 850 kV/2.7 meters of flexible portion, under said wet conditions; and allows a maximum conducting current of 2 mA when subjected to an AC phase-to-neutral voltage of 240 kV/2.7 meters of flexible portion, under dry conditions while carrying superheated steam;

the apparatus further comprising a nozzle connected to the output of the electrically non-conducting conduit for concentrating superheated steam into a pressurized jet usable for cleaning the live equipment; and an electrically non-conducting telescopic boom supporting the electrically non-conducting conduit and configured for positioning the nozzle near the live equipment to be cleaned, wherein the electrically non-conducting telescopic boom comprises one or more electrically non-conducting telescopic sections and withstands an AC phase-to-neutral voltage of 450 kV/2.7 meters of electrically non-conducting telescopic boom, at a frequency of 60 Hz, under dry conditions;

withstands an AC phase-to-neutral voltage of 240 kV/2.7 meters of electrically non-conducting telescopic boom, at a frequency of 60 Hz, under wet conditions similar to rain having a conductivity of 15 μS/cm; and withstands a switching voltage of 850 kV/2.7 meters of electrically non-conducting telescopic boom, under said wet conditions.

2. An apparatus according to claim 1, wherein the heating means has an operating range between 70 and 125 psig.

3. An apparatus according to claim 1, wherein the electrically non-conducting conduit comprises a rigid portion, the rigid portion of the electrically non-conducting conduit being at least 2 meters long.

4. An apparatus according to claim 3, wherein the rigid portion of the electrically non-conducting conduit withstands a maximum operating pressure of 150 psig.

5. An apparatus according to claim 3, wherein the rigid portion of the electrically non-conducting conduit withstands an AC phase-to-neutral voltage of 140 kV/meter of rigid portion, at a frequency of 60 Hz, under dry conditions while carrying superheated steam.

6. An apparatus according to claim 3, wherein the rigid portion of the electrically non-conducting conduit allows a maximum conducting current of 2 mA when subjected to an AC phase-to-neutral voltage of 52 kV/meter of rigid portion, under dry conditions while carrying superheated steam.

7. An apparatus according to claim 3, wherein the flexible portion of the electrically non-conducting conduit withstands a maximum operating pressure of 300 psig.

8. An apparatus according to claim 3, wherein the flexible portion of the electrically non-conducting conduit has an internal diameter ranging from ⅜ to ½ inch.

9. An apparatus according to claim 3, wherein the one or more electrically non-conducting sections has a total length ranging from 1 to 15 meters.

* * * * *

UNITED STATES PATENT AND TRADEMARK OFFICE

CERTIFICATE OF CORRECTION

PATENT NO. : 7,424,892 B2
APPLICATION NO. : 10/462817
DATED : September 16, 2008
INVENTOR(S) : Robert Lanoie, Dave Bouchard and Yvon Turcotte It is certified that error appears in the above-identified patent and that said Letters Patent is hereby corrected as shown below:

Column 3, line 67, reading "of micro Siemens per centimeter" should be changed to --of 15 micro Siemens per centimeter--.

Signed and Sealed this

Sixteenth Day of December, 2008

JON W. DUDAS
*Director of the United States Patent and Trademark Office*